US005535472A

United States Patent [19]

Miller

[11] Patent Number: 5,535,472

[45] Date of Patent: Jul. 16, 1996

[54] DENTURE CLEANER

[76] Inventor: George Miller, 2979 Shaffer Rd., Atwater, Ohio 44201

[21] Appl. No.: 354,755

[22] Filed: Dec. 8, 1994

[51] Int. Cl.[6] ..... A46B 13/06

[52] U.S. Cl. ..... 15/21.1

[58] Field of Search ..... 15/21.1, 24, 29, 15/88.2, 88.4, 69

[56] References Cited

U.S. PATENT DOCUMENTS

| | | | |
|---|---|---|---|
| 2,236,462 | 3/1941 | Binkley | 15/21.1 |
| 2,457,572 | 12/1948 | Leonard | 15/69 |
| 3,149,358 | 9/1964 | Chadbourne | 15/21.1 |
| 3,774,256 | 11/1973 | Gauthier | 15/21.1 |

FOREIGN PATENT DOCUMENTS

| | | | |
|---|---|---|---|
| 485386 | 3/1975 | Australia | 15/21.1 |
| 571856 | 1/1976 | Switzerland | 15/21.1 |

*Primary Examiner*—Edward L. Roberts, Jr.
*Attorney, Agent, or Firm*—Terrance L. Siemens

[57] ABSTRACT

A denture cleaner powered by a stream of falling water. A first rotary brush is geared to the gear. A second rotary brush is arranged at an angle to the first brush, with the bristles of the two brushes intersecting. The water falls onto a turbine or water wheel, which turns the first brush through a reducing gear. The first brush frictionally or interfittingly drives the second brush. Dentures are placed between the two brushes, and are held in place by the configuration of the cleaning chamber. Two pairs of brushes arranged in this manner are provided for cleaning two sets of dentures simultaneously. The water wheel is arranged selectively to divert a portion of the water stream into the cleaning chamber. A pocket having a perforated wall dispenses a cleaning agent into the cleaning chamber. The denture cleaner is thus independent of power from a manual, electric, or fluid pressure source, and operates without manual assistance from the user.

18 Claims, 2 Drawing Sheets

DENTURE CLEANER

BACKGROUND OF THE INVENTION

1. Field of the Invention

The present invention relates to apparatus having rotating brushes disposed within a cleaning chamber for cleaning dentures. The apparatus is placed in a stream of falling water and captures the energy therein to rotate the brushes.

2. Description of the Prior Art

Dentures must periodically be removed from a user's mouth and cleaned. Since dentures are placed in the mouth, careful attention to hygiene is a necessity, and accordingly, cleaning must be thorough and complete. At the same time, cleaning dentures can become a time consuming and odious chore if performed by hand. In recognition of this situation, the prior art has proposed brushing apparatus for cleaning dentures.

U.S. Pat. No. 3,774,256, issued to Oscar Gauthier on Nov. 27, 1973, discloses a brushing device having axially aligned, opposed brushes enclosed within a cleaning chamber. Dentures are placed within this chamber and cleaned when the brushes rotate. The brushes are electrically powered by a motor transmitting power through two paths to the upper and lower brushes.

The dentures are constrained against rotation when the brushes rotate by interference provided by a template. The dentures fit loosely within the template, so that a reasonable variety of sizes and shapes of dentures will be accommodated by one template. Nonetheless, Gauthier contemplates the necessity of providing a number of templates to assure that any one particular set of dentures will actually be successfully constrained against rotation.

Unlike the above apparatus, the present invention is dependent upon neither electricity for power nor a plurality of templates to hold the dentures in position for cleaning.

A denture cleaning chamber is featured in a brush device disclosed in U.S. Pat. No. 4,984,323, issued to Kevin C. Digby on Jan. 15, 1991. This device entraps dentures in the lower portion of a housing provided with stationary, upwardly projecting brush bristles. To entrap the dentures, the receptacle of the cleaning chamber has a truncated circular shape when viewed in plan. The chord truncating the circle is provided by an upright wall interfering with rotation of the dentures.

A cover closes the housing, and a brush is rotatably journaled within this cover. The upper brush is rotated by turning a handle projecting above the cover.

It should be noted that the bottom brush provided by the upwardly projecting bristles do not rotate relative to the dentures. Therefore, to enjoy the benefits of brushing motion, the dentures would have to be turned upside down and cleaned in a second operation.

By contrast, the present invention actively brushes both sides of the dentures in a single operation. No manual effort is required to rotate the brushes of the present inventive cleaning apparatus.

Fluid powered rotary brushes are illustrated in U.S. Pat. Nos. 1,412,400, issued to Joseph Gasser on Apr. 11, 1922, 1,657,880, issued to Lionel Fitz H. Carew on Jan. 31, 1928, 3,909,867, issued to Gunnar Hogsell on Oct. 7, 1975, and 4,783,871, issued to Joseph Rich, Jr. on Nov. 15, 1988. While such devices are no doubt suitable for their purposes, they cannot hold dentures in a fixed position and bring their respective brushes to bear effectively thereon. They also lack opposed bristles for surrounding an object to be cleaned in the manner that dentures should be cleaned. Unlike these devices, the present invention provides structure for securing the dentures in place, and has a brush arrangement for cleaning both sides of the dentures simultaneously.

U.S. Pat. No. 5,014,383, issued to Donald G. Costar on May 14, 1991, discloses a brush configured to cooperate with dentures for cleaning. The brush must be wielded by hand, and the dentures must be secured in place by hand. The apparatus of the present invention performs both of these functions automatically.

None of the above inventions and patents, taken either singly or in combination, is seen to describe the instant invention as claimed.

SUMMARY OF THE INVENTION

The present invention provides a brushing apparatus which automatically performs the principal functions required to brush dentures, these being securing the dentures in place, and rotating brushes contacting the dentures on both sides thereof. Two sets of brushes, for cleaning two items, are rotated simultaneously. The apparatus is independent of electrical power and yet does not require manual operation.

To these ends, a horizontally disposed water driven wheel is placed under falling water, and drives the brushes. One brush of each pair of brushes is directly driven from the wheel, and the second wheel is driven by frictional or interfitting engagement of bristles of both driving and driven brushes. This arrangement is highly desirable, since little power is squandered in such an uncomplicated arrangement. Thus, falling water can successfully be exploited for motive power.

The cleaning chamber is so configured as to hold the dentures in an operative position for cleaning. A conduit formed in the water wheel is arranged to enable water selectively to flow into the cleaning chamber and to be excluded from the cleaning chamber. The water conduit also has a second type of chamber in the form of a pocket open to the cleaning chamber, for dispensing a cleaning agent into the cleaning chamber.

A shield diverts water away from the cleaning chamber, when it is desired not to fill the cleaning chamber. As an alternative to excluding water from the cleaning chamber, water can be routed into the cleaning chamber by opening a valve formed in the shield. Water then enters the cleaning chamber, partially circulates through the same, and is discharged for disposal.

Accordingly, it is a principal object of the invention to provide a device for cleaning dentures which overcomes the disadvantages of the prior art.

It is another object of the invention to power the device in a manner independent of electrical power and manual effort.

Yet another object of the invention is to exploit the energy of falling water to drive the brushes.

It is a further object of the invention to hold dentures in a fixed, operative location during scrubbing.

It is an additional object of the invention to rotate brushes bearing on opposing sides of dentures simultaneously.

It is again an object of the invention to drive the brushes as directly as possible.

Another object of the invention is to clean two sets of dentures simultaneously.

Yet another object of the invention is to enable operation of the device selectively with the cleaning chamber filled with water or empty.

It is again an object of the invention to promote liquid circulation within the cleaning chamber when filling the same with cleaning liquid.

Still another object of the invention is to dispense a cleaning agent into water filling the cleaning chamber.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
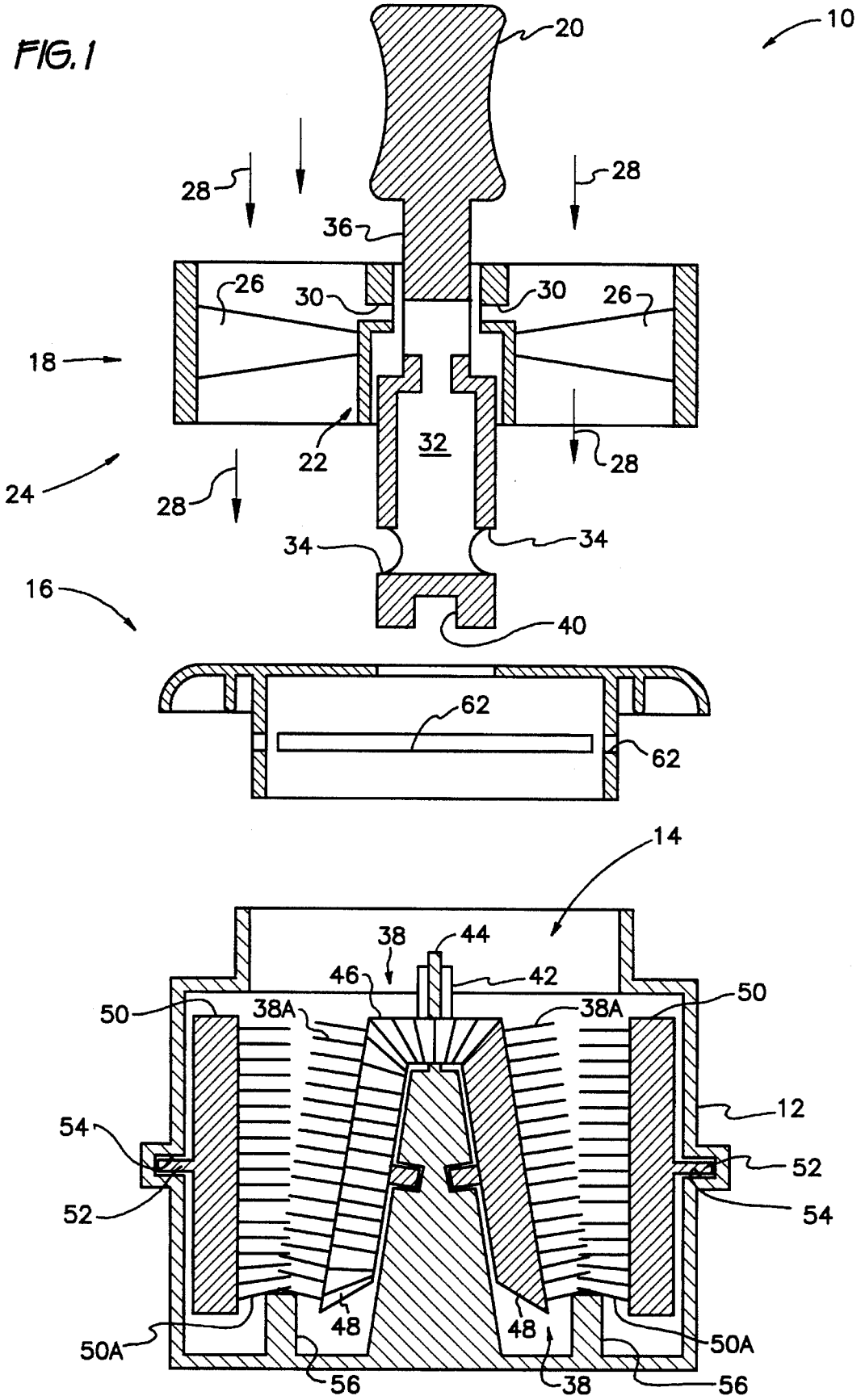
FIG. 1 is a diagrammatic, exploded side elevational view of the invention, with some components shown in cross section.

As seen in FIG. 1, the novel denture cleaner 10 includes a housing 12 enclosing a cleaning chamber 14, a shield 16 which can lower into housing 12, and a turbine assembly 18. Assembly 18 includes a central component including a handle 20 and a valve 22. A turbine 24 having blades or vanes 26 surrounds the central component.

Denture cleaner 10 is assembled by pressing assembly 18, shield 16, and housing 12 together into abutting relation.

When operated automatically, water flows down into and through turbine 24, as indicated by arrows 28. Water then strikes shield 16, and is diverted radially outwardly, and does not enter chamber 14.

To cause some of the water to enter chamber 14 to promote cleaning, the central component of turbine assembly 18 is maintained in the position shown. It will be seen from examination of FIG. 1 that openings 30 formed in turbine assembly 18 are in fluid communication with a bore 32 formed in the central component. Water descends through bore 32, and flows out from discharge holes 34, then flowing into chamber 14. Routing of water into and away from chamber 14 is accomplished by adjusting position of shield 16 on shaft 36. When the top wall of shield 16 is located above openings 34 of chamber 32, water enters chamber 14. When shield 16 is lowered so that openings 34 are located above the top wall of shield 36, water flows across shield 16, and falls down the outside of housing 12.

When this circulation of water is not desired, handle 20 is pushed downwardly. The solid shaft 36 of handle 20 then obstructs openings 30. All water entering turbine 24 then flows down onto shield 16, and is diverted away from chamber 14.

Regardless of whether water is routed into chamber 14, falling water rotates turbine 24. The central component of turbine assembly 18 is splined to turbine 24, so that while shaft 36 can move vertically with respect to 24, rotation of one will rotate the other.

This rotation powers brushes 38 in the following fashion. A splined socket 40 formed below valve 20 cooperates with splined drive shaft 42. Drive shaft 42 is journaled on a stud 44 projecting upwardly from and fixed to housing 12. A gear 46 fixed to drive shaft 42 engages gears 48 forming the base of brushes 38. Rotation of turbine 24, therefore, rotates drive shaft 42, which in turn rotates brushes 38 by engagement of gear 46 with gears 48.

Each brush assembly comprises brush 38 and a second brush 50 rotatably supported within housing 12 by support shafts 52 journaled in corresponding bores 54 formed in housing 12. Brushes 50 are driven by engagement of bristles 38A of brushes 38 with interfitting bristles 50A of brushes 50.

The brushing and subsequent cleansing of the dentures (not shown) is aided in part by an arcuate wall 56 protruding upwards into the rotating brushes 38. The function of arcuate wall 56 is to effect contact with, limit downward movement of the dentures, and cause a continuous slight movement of the dentures (not shown) upwards across the face of the rotating brush bristles 38A and 50A. Wall 56 constrains dentures from falling laterally out of engagement with brushes 48 and 50, and also constrains dentures front dropping downwardly out of engagement with brushes 48 and 50. Therefore, dentures are loosely held in operative position for cleaning.

Figure 2:
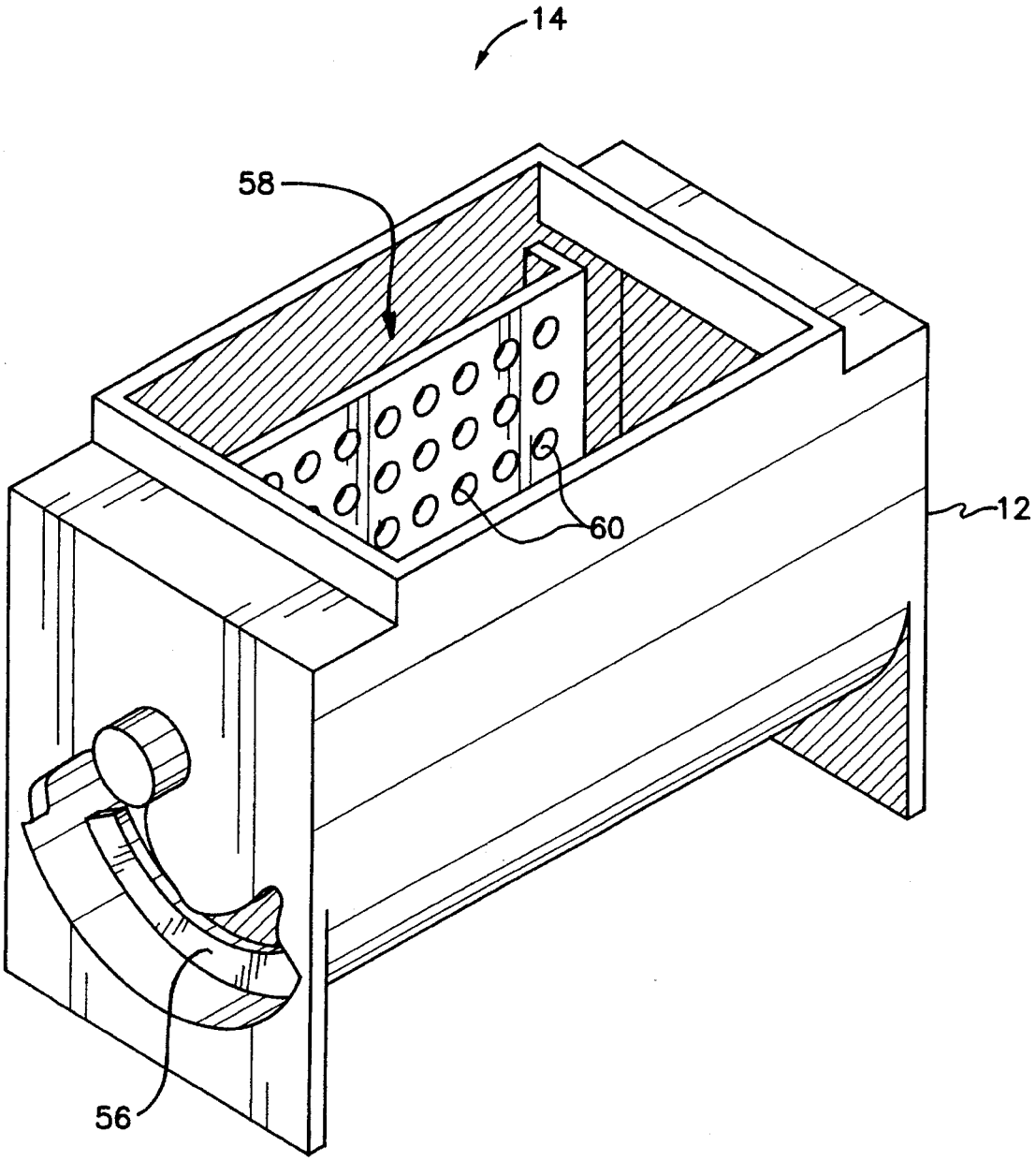
FIG. 2 is a perspective view of the invention, partly broken away to reveal internal detail.

Referring now to FIG. 2, dentures (not shown) are held in place within housing 12 by cooperative interfit with arcuate walls 56. Dentures are placed in housing 12 between a pair of brushes 38 and 50 (see FIG. 1), and pushed downward into contact with arcuate wall 56. Obviously, dentures cleaner accommodates two dentures simultaneously. The dentures are cleaned when brushes 38 and 50 rotate, with respective bristles 38A and 50A bearing against the dentures.

Cleaning is enhanced by dissolving a cleansing chemical (not shown) into the water filling chamber 14. Suitable cleansing chemicals are available in tablet form. To employ cleansing chemicals in the present invention, a tablet is placed in a pocket 58 formed in housing 12 prior to operating the invention. Perforations 60 formed in the interior wall of pocket 58 enable water solution of the cleansing chemical to permeate into chamber 14, and thus to act on dentures.

The water circulation scheme described above does not flush cleansing chemical rapidly from pocket 58, which would quickly deplete the cleansing chemical. Shield 16 is positioned just high enough above housing 12 so that openings 62 are not obstructed. Water flows into chamber 14, and then, referring again to FIG. 1, flows laterally to slots 62 formed in shield 16, and then out of housing 12. This circulation scheme assures that the concentration of cleansing chemical obtained from the dissolving tablet will remain high enough to maintain its effectiveness.

Turbine assembly 18 fits centrally within shield 16. Shield 16 and housing 12 are friction fit together, and are manually disassembled after use so that dentures may be removed, and denture cleaner 10 may be rinsed in preparation for its next use.

It is to be understood that the present invention is not limited to the embodiments described above, but encompasses any and all embodiments within the scope of the following claims.

I claim:

1. Apparatus for cleaning dentures, comprising:

a housing defining a cleaning chamber therein, said housing rotatably supporting therein at least one pair of brushes having bristles, one said brush facing another said brush, and one said brush rotatably and interfittingly engaging another said brush through said bristles; and a turbine drivingly connected to at least one said brush, whereby a liquid flowing through said turbine drives said turbine and at least one said brush and said brush being driven by said turbine in turn drives another said brush through said interfittingly engaging bristles.

2. The apparatus according to claim 1, each said brush disposed at an angle to another said brush, whereby interfitting engagement of brushes occurs at one point along the circumference of said brushes, and said bristles of one said brush are spaced apart from said bristles of another said brush at another point along the circumference of said brushes, whereby dentures can be placed between and in contact with both said brushes.

3. The apparatus according to claim 1, further comprising a liquid conduit conducting liquid from the liquid stream into said cleaning chamber, whereby cleaning liquid is supplied by the liquid also providing power.

4. The apparatus according to claim 3, further comprising a valve selectively opening said liquid conduit to and closing said liquid conduit.

5. The apparatus according to claim 3, said housing further comprising a pocket having a perforated wall, disposed in liquid communication with said liquid conduit, whereby a cleaning agent placed in said pocket is dissolved in liquid and introduced into said cleaning chamber.

6. The apparatus according to claim 1, said turbine having a vertical rotational axis, said apparatus further comprising a shield disposed below said turbine and above said cleaning chamber, for diverting liquid away from said cleaning chamber.

7. The apparatus according to claim 1, at least one said brush having circumferential gear teeth, said apparatus further comprising a vertical stem attached to said housing, for supporting said turbine, said turbine further comprising a hollow axle encircling said steam and a gear disposed thereon, for drivingly engaging at one said brush having circumferential gear teeth.

8. The apparatus according to claim 7, further comprising two pairs of cleaning brushes, each said pair including one brush having circumferential gear teeth, said apparatus further comprising a vertical stem attached to said housing, for supporting said turbine, said turbine further comprising a hollow axle encircling said stem and a gear disposed thereon, for drivingly engaging at least one said brush having circumferential gear teeth.

9. The apparatus according to claim 1, further comprising two pairs of cleaning brushes, one said pair of cleaning brushes located apart from the other said pair of cleaning brushes.

10. The apparatus according to claim 1, further comprising a removable shield interposable between said turbine and said cleaning chamber.

11. Apparatus for cleaning dentures, comprising:

a housing defining a cleaning chamber there, said housing rotatably supporting therein at least one pair of brushes having bristles, one said brush facing another said brush, and one said brush rotatably and interfittingly engaging another said brush, each said brush disposed at an angle to another said brush, whereby interfitting engagement of brushes occurs at one point along the circumference of said brushes, and said bristles of one said brush are spaced apart from said bristles of another said brush at another point along the circumference of said brushes, whereby dentures can be placed between and in contact with both said brushes;

a turbine connected to at least one said brush, at least one said brush having circumferential gear teeth, said apparatus further comprising a vertical stem attached to said housing, for supporting said turbine, said turbine further comprising a hollow axle encircling said stem and a gear disposed thereon, for drivingly engaging at least one said brush having circumferential gear teeth; and a liquid conduit communicating between said turbine and said cleaning chamber, said liquid conduit further comprising a valve selectively opening said liquid conduit and closing said liquid conduit to said cleaning chamber.

12. The apparatus according to claim 11, further comprising a liquid conduit conducting liquid from the liquid stream into said cleaning chamber, whereby cleaning liquid is supplied by the liquid also providing power.

13. The apparatus according to claim 12, said housing further comprising a pocket having a perforated wall, disposed in liquid communication with said liquid conduit, whereby a cleaning agent placed in said pocket is dissolved in liquid and introduced into said cleaning chamber.

14. The apparatus according to claim 11, said turbine having a vertical rotational axis, said apparatus further comprising a shield disposed below said turbine and above said cleaning chamber, for diverting liquid away from said cleaning chamber.

15. The apparatus according to claim 11, further comprising two pairs of cleaning brushes, each said pair including one brush having circumferential gear teeth, said apparatus further comprising a vertical stem attached to said housing, for supporting said turbine, said turbine further comprising a hollow axle encircling said stem and a gear disposed thereon, for drivingly engaging at least one said brush having circumferential gear teeth.

16. Apparatus for cleaning dentures, comprising:

a housing defining a cleaning chamber therein, said housing rotatably supporting therein two pairs of brushes having bristles, one said brush facing another said brush, and one said brush rotatably and interfittingly engaging another said brush, each said brush disposed at an angle to another said brush, whereby interfitting engagement of brushes occurs at one point along the circumference of said brushes, and said bristles of one said brush are spaced apart from said bristles of another said brush at another point along the circumference of said brushes, whereby dentures can be placed between and in contact with both said brushes;

a turbine having blades or vanes for deriving power from a stream of moving liquid, said turbine drivingly connected to at least one said brush, at least one said brush having circumferential gear teeth, said apparatus further comprising a vertical stem attached to said housing, for supporting said turbine, said turbine further comprising a hollow axle encircling said stent and a gear disposed thereon, for drivingly engaging at least one said brush having circumferential gear teeth; and a liquid conduit communicating between said turbine and said cleaning chamber, said liquid conduit further comprising a valve selectively opening said liquid conduit and closing said liquid conduit to said cleaning chamber;

said housing further comprising a pocket having a perforated wall, disposed in liquid communication with said liquid conduit, whereby a cleaning agent placed in said pocket is dissolved in liquid and introduced into said cleaning chamber.

17. The apparatus according to claim 16, further comprising shield disposed below turbine and above said cleaning chamber, for diverting liquid away from said cleaning chamber.

18. The apparatus according to claim 17, said shield further including a peripheral vertical wall which projects into said cleaning chamber, said vertical wall including means defining slots therein for exhausting liquid entering said cleaning chamber from above.

* * * * *